United States Patent [19]

Rickelton

[11] Patent Number: 4,778,663

[45] Date of Patent: Oct. 18, 1988

[54] URANIUM RECOVERY FROM WET PROCESS PHOSPHORIC ACID UNSYMMETRICAL PHOSPHINE OXIDES

[75] Inventor: William A. Rickelton, Niagara Falls, Canada

[73] Assignee: American Cyanamid Company, Stamford, Conn.

[21] Appl. No.: 90,178

[22] Filed: Aug. 27, 1987

[51] Int. Cl.[4] ..... C01G 43/00

[52] U.S. Cl. ..... 423/10

[58] Field of Search ..... 423/10

[56] References Cited

U.S. PATENT DOCUMENTS

| | | | |
|---|---|---|---|
| Re. 31,686 | 9/1984 | Hurst et al. | 423/10 |
| 2,859,094 | 11/1958 | Schmitt et al. | 423/10 |
| 3,836,476 | 9/1974 | Baldwin et al. | 423/10 |
| 4,212,849 | 7/1980 | Lucid et al. | 423/10 |
| 4,356,153 | 10/1982 | Bathellier et al. | 423/10 |
| 4,382,066 | 5/1983 | Rose | 423/10 |

*Primary Examiner*—Edward A. Miller

*Attorney, Agent, or Firm*—Frank M. Van Riet; Michael J. Kelly

[57] ABSTRACT

This invention relates to a process for the recovery of uranium from wet process phosphoric acid. More particularly, it concerns the use of a combination of a dialkyl phosphoric acid and a mixture of trialkyl phosphine oxides to extract uranium from wet process phosphoric acid.

9 Claims, No Drawings

URANIUM RECOVERY FROM WET PROCESS PHOSPHORIC ACID UNSYMMETRICAL PHOSPHINE OXIDES

BACKGROUND ON THE INVENTION

The so-called "wet process" phosphoric acid, produced by the acidification of phosphate rock, contains a significant amount of uranium, typically 0.1 to 0.2 grams per liter. Accordingly, the recovery of uranium from wet process phosphoric acid can provide part of this important nuclear fuel source material supply. It has been demonstrated that the most efficient means of recovering the uranium is by a liquid-liquid solvent extraction. In a publication by the U.S. Atomic Energy Commission, ORNL-TM-2522 (1969), entitled "Solvent Extraction of Uranium From Wet-Process Phosphoric Acid," a process is described in which an aqueous solution of uranium-containing phosphoric acid is contacted with an extractant combination of di(2-ethylhexyl)phosphoric acid (DEHPA) and trioctylphosphine oxide (TOPO) dissolved in an organic diluent. The uranium is then stripped from the DEHPA/TOPO extractant solution by the use of ammonium carbonate. Further refinements of this process are reported in an article entitled "Recovery of Uranium From Wet-Process Phosphoric Acid" by F. J. Hurst et al, Ind. Eng. Chem. Process Des. Develop. 11 (1) 122 (1972) and in U.S. Pat. No. 3,711,591. The process flow sheet disclosed in the latter two references involve a two-cycle extraction. In the first cycle, the uranium-containing wet process phosphoric acid is treated with an oxidizing agent to oxidize the uranium to the hexavalent ($U^{+6}$) state and is then contacted with a mixture of TOPO and DEHPA at a 1:4 molar ratio dissolved in a water-immiscible aliphatic hydrocarbon diluent. The uranium is recovered from the organic solvent by a reductive stripping process involving the use of ferrous ion to reduce the uranium to the less extractable tetravalent ($U^{+4}$) state. In the second cycle, the uranium is re-oxidized to the $U^{+6}$ state and re-extracted with a DEHPA/TOPO solution at 1:4 molar ratio in a diluent and then stripped with ammonium carbonate to precipitate ammonium uranyl tricarbonate (AUT). The latter is calcined to form $U_3O_8$.

While the above process has been successfully used on a commercial scale, a need still exists for a more efficient process to recover the relatively small amounts of valuable uranium from the wet process phosphoric acid.

It has now been unexpectedly discovered that enhanced extraction of uranium from wet process phosphoric acid can be obtained with a solvent extractant combination of dialkyl phosphoric acid, e.g. DEHPA, and a mixture of phosphine oxides containing unsymmetrical tertiary phosphine oxides. The phosphine oxide mixture containing at least four components is prepared by the reaction of phosphine and a mixture of two olefins followed by oxidation of the resulting trialkyl phosphine mixture to the corresponding tertiary phosphine oxides. The amount of each component is carefully controlled by the ratio of the two olefins reacted with phosphine in the range of 10:90 to about 90:10 and preferably, in the range of 60:40 to 40:60. The instant process is advantageous in that it provides substantially higher uranium extraction efficiency than the conventional TOPO/DEHPA extraction solvent mixture, thus reducing the number of extraction stages and resulting in increased overall productivity.

The tertiary phosphine oxide mixture used in the process of this invention is disclosed in European Patent Application No. 132700, published Feb. 13, 1985. This mixture is reported to extract acetic acid and phenol from aqueous solutions. It has now been found that a combination of this mixture with dialkyl phosphoric acid could be used to extract uranium from phosphoric acid solutions.

SUMMARY OF THE INVENTION

Provided in accordance to the present invention are processes for extracting uranium from aqueous phosphoric acid solutions, which process comprises:

(a) contacting said aqueous phosphoric acid solution with a solvent extractant combination of a dialkyl phosphoric acid and a tertiary phosphine oxide mixture having at least four different components, each of said components having the same general formula;

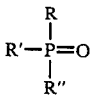

wherein R, R′, R″ are the same or different saturated hydrocarbon radicals of 6 to about 16 carbon atoms, and at least two components of said tertiary phosphine oxide mixture being unsymmetrical tertiary phosphine oxides containing at least one R, R′, R″ group different from the other said groups;

(b) separating the resulting dialkyl phosphoric acid-phosphine oxide-uranium complex from said aqueous phosphoric acid solution; and (c) recovering the uranium from said complex.

Further provided by the present invention are processes defined above, wherein said tertiary phosphine oxide mixture contains four components in which R is n-octyl, R′ is n-hexyl and R″ is either n-hexyl or n-octyl.

Preferred are processes wherein said tertiary phosphine oxide mixture is prepared from the reaction of phosphine and a mixture of 1-octene and 1-hexene in the ratio 90:10 to about 10:90. Most preferred are processes wherein said tertiary phosphine oxide mixture is prepared from a mixture of 1-octene and 1-hexene in the ratio of 60:40 by weight.

DETAILED DESCRIPTION OF THE INVENTION

In accordance with this invention, under typical commercial conditions, an effective amount of the extractant is added to a wet process phosphoric acid which has been oxidized with oxidizing agents, e.g. hydrogen peroxide to convert the uranium species to the hexavalent ($U^{+6}$) state. The ratio of the aqueous phosphoric acid phase to the extractant organic phase may generally vary from 20:1 to about 1:20 by volume. However, a ratio in the range of 5:1 to about 1:1 will usually be found to be effective.

The extractant comprises a combintion of a dialkyl phosphoric acid and a tertiary phosphine oxide mixture in the molar ratio of about 10:1 to about 1:1, preferably about 4:1. The said extractant combination may be used "neat" or dissolved in a difluent, typically of the hydrocarbon type. When a diluent is used, the concentration of the dialkyl phosphoric acid should generally be in the range of about 0.5M to about 1.0M (moles per liter of diluent) and the concentration of the tertiary phospine oxide should generally be in the range of about 0.05M to about 0.5M.

The mixture tertiary phosphine oxides for use in this invention are mixtures having at least four different components, each having the same general formula RR'R"PO in which R, R' and R" within each component species may be the same or different saturated hydrocarbon radicals of 6 to about 16 carbon atoms, and at least two components being unsymmetrical tertiary phosphine oxides containing at least one R, R', R" group different from the other said groups.

Suitable tertiary phosphine oxides for use in the instant process include, but are not limited to, mixtures containing any of the foregoing alkyl substituents. They may preferably be four component mixtures having the formulae $R_3PO$, $R'_3PO$, $R_2R'PO$ and $RR'_2PO$ wherein R and R' is represented by a saturated hydrocarbon radical, e.g. n-octyl and n-hexyl; however, ten component mixtures having the formulae $R_3PO$, $R'_3PO$, $R''_3PO$, $R_2R'PO$, $R_2R''PO$, $RR'_2PO$, $RR''_2PO$, $R'_2R''PO$, $R'R''_2PO$, RR'R"PO, wherein R, R' and R" is represented by a saturated hydrocarbon radical, e.g. hexyl, octyl and decyl, may also be useful.

The tertiary phosphine oxide mixtures may be prepared by the reaction of phosphine and a mixture of two olefins, e.g. 1-octene and 1-hexene, in the presence of a free-radical initiator, such as azobis(isobutyronitrile), which will give a four component mixture of tertiary phosphines which is then oxidized by hydrogen peroxide to give the corresponding mixture of tertiary phosphine oxides. Alternatively, phosphine may be reacted with a mixture of three olefins, e.g. hexene, octene and decene, which will give a ten-component mixture of tertiary phosphine oxides.

As will be exemplified in the next section, it has been found that extraction is generally enhanced if the percentage of each tertiary phosphine oxide in the tertiary phosphine oxide mixture is carefully controlled by the appropriate mixture of the olefins used in the reaction with phosphine. The ratio of olefins that may be used in the preparation of the four component mixture of tertiary phosphine oxides can range from about 90:10 to about 10:90, preferably from about 60:40 to about 40:60 by weight. Examples of such mixtures include, but are not limited to: trihexylphosphine oxide, trioctylphosphine oxide, dihexyloctylphosphine oxide, dioctylhexylphosphine oxide prepared from a 1-hexene/1-octene olefin mixture; trihexylphosphine oxide, tridecylphosphine oxide, dihexyldecylphosphine oxide, didecylhexylphosphine oxide, prepared from a 1-hexene/1-decene olefin mixture: trioctylphosphine oxide, tridecylphosphine oxide, dioctyldecylphosphine oxide, didecyloctylphosphine oxide, prepared from a 1-octene/1-decene olefin mixture, and the like. A preferred tertiary phosphine oxide mixture is prepared from a 60:40 mixture of 1-octene:1-hexene.

Suitable dialkyl phosphoric acids for use in combination with the tertiary phosphine oxide mixture in the instant process have from about 6 to about 16 carbon atoms per alkyl group. Representative dialkyl phosphoric acids for use in the instant process include, but are not limited to, di(2-ethylbutyl)phosphoric acid, di(2-ethylhexyl)phosphoric acid, di(2-ethyldecyl)phosphoric acid, di(2-ethyldodecyl)phosphoric acid, bis(2,4,4-trimethylpentyl)phosphoric acid, and the like. The preferred dialkyl phosphoric acid is di(2-ethylhexyl)phosphoric acid (DEHPA). The dialkyl phosphoric acids useful in this invention can be prepared by methods known to those skilled in the art or are available commercially. For example, di(2-ethylhexyl)phosphoric acid is available from MOBIL Chemical Company under the name $D_2EHPA$, and Daihachi Chemical Company, under the tradename DP-8R.

Suitable diluents for the tertiary phosphine oxide/dialkyl phosphoric acid extractant mixture of this invention include water-immiscible hydrocarbons including, but not limited to, toluene, xylene, kerosene, and the like. The preferred diluents are aliphatic type hydrocarbons, such as, for example, Ashland®140 available from Ashland Chemicals; however, the particular diluent is not critical so long as it is compatible with the process.

In carrying out the process of this invention, the uranium-bearing aqueous phosphoric acid solution is contacted either by batch or continuously counter-current with the solvent extractant combination of the dialkylphosphoric acid and the tertiary phosphine oxide mixture. The aqueous to organic phase, e.g. A/O volume, is chosen to most effectively remove the uranium. In the absence of a diluent, A/O ratios of about 5:1 to about 1:5, preferably about 3:1 to about 1:3, have been found to be effective. In the presence of a diluent, A/O ratios of about 20:1 to about 1:20, preferably about 3:1 to about 1:3, are effective. Phase contact is commonly achieved in devices known to those working in this art as "mixer-settlers," although many other types of devices, such as liquid-liquid extraction columns, are available. The dialkyl phosphoric acid-tertiary phosphine oxide extractant combination then forms a complex with the uranium, which, if it is not there already, has been pre-oxidized to $U^{+6}$ oxidation state. The complex reports to the organic phase of the two-phase liquid mixture and the dispersion then flows to the settler where phase disengagement occurs under quiescent conditions. Generally, the extraction is carried out between about 10° to about 100° C., preferably at about 20° to about 70° C.

The uranium-loaded organic phase may be treated with a stripping agent to remove the uranium from the organic phase back into the aqueous phase for subsequent isolation of, the uranium salt or more preferably, the organic, uranium-loaded phase may be further treated by a reductive stripping process, such as described in U.S. Pat. No. 3,711,591. In the reductive stripping process, the loaded organic phase is treated (for example—with ferrous ion dissolved in phosphoric acid) to reduce the uranium to the less extractable tetravalent $U^{+4}$ oxidation state which is removed from the complex and enters into the aqueous phase. The aqueous, more concentrated solution of $U^{+4}$ may then be re-oxidized to the hexavalent ($U^{+6}$) oxidation state and then can be re-extracted in a second cycle with the solvent extractant dialkyl phosphoric acid/tertiary phosphine oxide mixture. The loaded organic phase can then be treated with a stripping agent, such as, for example, ammonium carbonate, to precipitate ammonium uranyl tricarbonate (AUT) which may then be isolated and calcined to $U_3O_8$. Other stripping agents may be used in this process and they include, but are not limited to, sodium hydroxide, potassium hydroxide, ammonium hydroxide, sodium carbonate, and the like. The stripped organic phase separated from the aqueous, AUT-containing aqueous phase is utilized again to extract uranium from wet process phosphoric acid solution as previously described.

DESCRIPTION OF THE PREFERRED EMBODIMENTS

The following examples illustrate the processes of the present invention. They are not to be construed to limit the invention in any manner whatsoever. All parts and percentages are by weight unless otherwise specified.

Procedure A

Phosphine was reacted in an autoclave with an olefin mixture composed of 60% by weight 1-octene and 40% by weight 1-hexene using azobis(isobutyronitrile) as the free-radical catalyst at 80° C. for a total of five hours. The excess phosphine was vented, and the resulting mixture was analyzed by gas chromatography and then oxidized with 25% hydrogen peroxide solution at 50°-60° C. for 2 hours. The tertiary phosphine oxide was isolated as a liquid (freezing point, less than 10° C.) by vacuum stripping of water and unreacted olefins. It contained 15.6% tri-n-octylphosphine oxide, 8.2% tri-n-hexylphosphine oxide, 38.1% di-n-octyl-n-hexylphosphine oxide and 30.9% n-octyl-di-n-hexylphosphine oxide.

Procedure B

Phosphine was reacted in an autoclave with an olefin mixture composed of 50% 1-octene and 50% 1-hexene by weight according to Procedure A. The tertiary phosphine mixture obtained was oxidized with hydrogen peroxide to give a liquid mixture of the corresponding tertiary phosphine oxides. The distribution of the four components in the tertiary phosphine oxide mixture was as follows: 7.1% tri-n-octylphosphine oxide, 20.5% tri-n-hexylphosphine oxide, 30.3% di-n-octyl-hexylphosphine oxide and 42.1% di-n-hexyl-n-octyl-phosphine oxide.

Example 1

Equal volume samples of aqueous, oxidized wet process phosphoric acid containing 0.120 grams per liter uranium ($U^{+6}$) were contacted with a solvent extractant (organic phase) containing 78.7 parts (by weight), di(2-ethylhexyl)phosphoric acid (DEHPA) and 21.3 parts (by weight) of the liquid phosphine oxide mixture of Procedure A. The aqueous and organic phases were shaken for 10 minutes at 40° C. to complete equilibration. The aqueous phase (raffinate) was separated from the organic phase and analyzed for uranium. The concentration of uranium in the organic phase was calculated by mass balance. Control solvent extractant mixture of 76.9 parts (by weight) DEHPA and 23.1 parts (by weight) tri-n-octylphosphine oxide (TOPO) were also contacted with the above uranium-bearing aqueous phosphoric acid solution for 10 minutes at 40° C., at an aqueous to organic ratio of one (by volume). The uranium concentration was determined as above in the aqueous raffinate and organic phase. The extraction coefficient (E) was calculated as the ratio of the equilibrium concentration of uranium in the organic phase divided by the equilibrium concentration of uranium in the aqueous phase. The test results are set forth in Table I below.

TABLE I

Uranium Recovery From Wet Process Phosphoric Acid

| Example | 1A* | 1 |
|---|---|---|
| Compositions (parts by weight, w/o) | | |
| DEHPA | 76.9 | 78.7 |
| TOPO | 23.1 | — |
| Tert. Phosphine Oxide of Procedure A | — | 21.3 |
| Extractive Properties | | |
| Raffinate uranium (gpl) | 0.005 | 0.004 |
| Organic uranium (gpl) | 0.125 | 0.126 |
| Extraction coefficient (E°C.) | 25.0 | 31.5 |

*Control

The results indicate that an extractant combination of DEHPA and a tertiary phosphine oxide mixture prepared from a 60/40 mixture of 1-octene and 1-hexene and phosphine provide better uranium extraction than the conventional DEHPA/TOPO extractant combination.

Examples 2-7

Samples of aqueous wet process phosphoric acid (WPPA) solution containing 0.118 grams per liter uranium ($U^{+6}$) (pre-oxidized with hydrogen peroxide) were contacted with samples of organic solvent extractant solutions containing 0.5 moles per liter DEHPA and various molar concentrations (0.05M, 0.08M, 0.1M, 0.125M and 0.3M) of the tertiary phosphine oxide of Procedure B in an aliphatic hydrocarbon (Ashland®140) diluent. The shake-out tests were conducted at an aqueous to organic (A/O) volume ratio of 1 for 10 minutes at 40° C. After equilibration the aqueous phase in each test was analyzed for uranium. The uranium concentration in the organic phase was calculated by mass balance.

Control solvent extraction solutions containing 0.5M (moles per liter) DEHPA and varying molar concentrations (0 to 0.3M) TOPO in the above aliphatic hydrocarbon diluent were also contacted with the above wet process phosphoric acid solution at an A/O ratio of 1, and the uranium concentration was determined in the aqueous phase. The extraction coefficients (E) were calculated for each shake-out test, involving mixtures of DEHPA and the appropriate tertiary phosphine oxide. Extractant compositions and extraction results are set forth in Table II. The results shown in Table II demonstrate the superior extraction efficiency of the tertiary phosphine oxide mixture used in accordance with the processes of this invention over conventional solvent extractants.

TABLE II

Uranium Extraction From Wet Process Phosphoric Acid

| Example | 2A* | 2 | 3A* | 3 | 4A* | 4 | 5A* | 5 | 6A* | 6 | 7A* | 7 |
|---|---|---|---|---|---|---|---|---|---|---|---|---|
| DE2HPA (Moles per liter) | 0.5 | 0.5 | 0.5 | 0.5 | 0.5 | 0.5 | 0.5 | 0.5 | 0.5 | 0.5 | 0.5 | 0.5 |
| TOPO (Moles per liter) | — | — | 0.05 | — | 0.08 | — | 0.1 | — | 0.125 | — | 0.3 | — |
| Tert. Phosphine Oxide-Procedure B (Moles per liter) | — | — | — | 0.05 | — | 0.08 | — | 0.1 | — | 0.125 | — | 0.3 |
| Extractive Properties | | | | | | | | | | | | |
| Raffinate uranium (mg/L) | 109 | 109 | 52.1 | 26.5 | 43.3 | 26.5 | 43.3 | 35.0 | 39.3 | 33.0 | 52.1 | 28.5 |

TABLE II-continued

| | Uranium Extraction From Wet Process Phosphoric Acid | | | | | | | | | | | |
|---|---|---|---|---|---|---|---|---|---|---|---|---|
| Example | 2A* | 2 | 3A* | 3 | 4A* | 4 | 5A* | 5 | 6A* | 6 | 7A* | 7 |
| Extraction coefficient (E) | 0.08 | 0.08 | 1.26 | 3.45 | 1.73 | 3.45 | 1.73 | 2.37 | 2.00 | 2.57 | 1.26 | 3.14 |

*Control

Examples 8–12

Following the procedure in Examples 2–7, samples of wet process phosphoric acid containing 0.118 grams per liter hexavalent uranium ($U^{+6}$) were shaken for 10 minutes at 40° C. with equal volumes (A/O=1) of solutions containing 0.5M (moles per liter) DEHPA and varying molar concentrations of the tertiary phosphine oxide mixture of Procedure A in an aliphatical hydrocarbon diluent (Ashland ®140). The uranium concentrations was determined in the aqueous phase after each shake-out test and the extraction coefficient (E) was calculated for each extractant mixture.

Control tests were also carried out by shaking equal volumes of the above phosphoric acid solution and mixtures containing 0.5M DEHPA and varying molar concentration of TOPO in the above aliphatic hydrocarbon diluent.

The solvent extractant composition and uranium extraction coefficients are shown in Table III.

TABLE III

| Example | 8A* | 8 | 9A* | 9 | 10A* | 10 | 11A* | 11 | 12A* | 12 |
|---|---|---|---|---|---|---|---|---|---|---|
| DEHPA (Moles per liter) | 0.5 | 0.5 | 0.5 | 0.5 | 0.5 | 0.5 | 0.5 | 0.5 | 0.5 | 0.5 |
| TOPO (Moles per liter) | 0.05 | — | 0.08 | — | 0.10 | — | 0.125 | — | 0.3 | — |
| Tert. Phosphine oxide-Procedure A (Moles per liter) | — | 0.05 | — | 0.08 | — | 0.10 | — | 0.125 | — | 0.3 |
| Extraction Coefficient (E) | 1.26 | 1.54 | 1.73 | 1.72 | 1.73 | 2.16 | 2.00 | 2.34 | 1.26 | 1.39 |

The above patents and publications are incorporated herein by reference.

Many variations will suggest themselves to those skilled in the art in light of the above detailed description. For example, instead of a four-component mixture of tertiary phosphine oxides, prepared from a two-olefin mix, e.g. hexene, octene, ten-component tertiary phosphine oxide mixtures can be used. The latter are prepared by the reaction of phosphine and a mixture of three olefins, e.g. 1-hexene, 1-octene, 1-decene, followed by oxidation of the resulting ten-component tertiary phosphine mixture to the corresponding tertiary phosphine oxides. In addition, the solvent extractant combination of dialkyl phosphoric acid-tertiary phosphine oxide mixture may be supported on solid inert support materials, such as diatomaceous earth, or encapsulated in porous polymeric beads of cross-linked polystyrene. The latter may further comprise styrene-divinylbenzene copolymer.

I claim:

1. A process for the selective extraction of uranium from wet process phosphoric acid solutions, which process comprises:

(a) contacting said acid solution with a mixture comprising a dialkyl phosphoric acid and a tertiary phospine oxide mixture containing at least four different components each of the same general formula RR'R''PO wherein R, R', R'' are the same or different saturated hydrocarbon radicals of 6 to about 16 carbon atoms, and at least two components of said tertiary phosphine oxide mixture being unsymmetrical tertiary phosphine oxides containing at least one R, R', R'' group different from the other said groups;

(b) separating the resulting phosphine oxide-uranium complex from said phosphoric acid solution.

2. A process as defined in claim 1 wherein said tertiary phosphine oxide mixture contains four components $R_3PO$, $R'_3PO$, $R_2R'PO$ and $RR'_2PO$ in which R is hexyl and R' is octyl.

3. A process as defined in claim 2 wherein said tertiary phosphine oxide mixture is prepared by the reaction of phosphine and about 90:10 to about 10:90 mixture of 1-hexene, 1-octene, followed by oxidation.

4. A process as defined in claim 3 wherein said tertiary phosphine oxide mixture is derived from about 60:40 to about 40:60 mixture of 1-hexene, 1-octene.

5. A process as defined in claim 4 wherein said tertiary phosphine oxide mixture is derived from a 60:40 mixture of 1-octene, 1-hexene.

6. A process as defined in claim 1 wherein said dialkylphosphoric acid is di(2-ethylhexyl)phosphoric acid.

7. A process as defined in claim 1 wherein said solvent extractant combination is dissolved in a water-immiscible hydrocarbon diluent.

8. A process as defined in claim 7 wherein said hydrocarbon diluent is an aliphatic hydrocarbon diluent.

9. A process as defined in claim 1 wherein said tertiary phosphine oxide mixture is absorbed on or encapsulated in an inert support material.

* * * * *